United States Patent [19]

Cayless et al.

[11] Patent Number: 4,536,225

[45] Date of Patent: Aug. 20, 1985

[54] SURFACE TREATMENT OF METAL

[75] Inventors: Richard A. Cayless, Wandsworth; Prem S. Thukral, Sunbury-on-Thames, both of England

[73] Assignee: The British Petroleum Company p.l.c., London, England

[21] Appl. No.: 636,599

[22] Filed: Aug. 1, 1984

[30] Foreign Application Priority Data

Aug. 6, 1983 [GB] United Kingdom ..... 8321253

[51] Int. Cl.[3] ..... C23F 7/10

[52] U.S. Cl. ..... 148/6.15 R

[58] Field of Search ..... 148/6.15 R

[56] References Cited

U.S. PATENT DOCUMENTS

| | | | |
|---|---|---|---|
| 2,080,299 | 5/1937 | Benning | 148/6.15 R |
| 2,952,699 | 9/1960 | Noanan | 148/6.15 R |
| 2,986,482 | 5/1961 | Sharp | 148/6.15 R |
| 3,397,150 | 8/1968 | Burt | 148/6.15 R |

FOREIGN PATENT DOCUMENTS

| | | | |
|---|---|---|---|
| 49-21020 | 5/1974 | Japan | 148/6.15 R |

*Primary Examiner*—Sam Silverberg

*Attorney, Agent, or Firm*—Morgan, Finnegan, Pine, Foley & Lee

[57] ABSTRACT

A method of inhibiting corrosion of a metal surface comprises applying to the metal surface an organic solvent in which is dissolved a phosphate monoester of a hydroxyalkyl acrylate or a hydroxyalkyl alkylacrylate which phosphate monoester has the general formula;

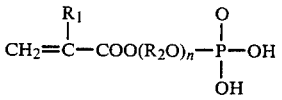

where $R_1$ is hydrogen, a methyl group or an ethyl group $R_2$ is an alkyl group having from 2 to 10 carbon atoms and n is a positive integer from 1 to 20

The solution may also contain a diester of a hydroxyalkyl acrylate, a diester of a hydroxyalkyl alkylacrylate, hydroxyalkyl acrylate or hydroxyalkyl alkylacrylate.

The method may also improve the adhesive strength of a subsequently applied protective coating e.g. paint.

16 Claims, No Drawings

SURFACE TREATMENT OF METAL

SURFACE TREATMENT OF METAL

The present invention relates to a method of treating the surface of metal to inhibit corrosion.

Various methods are known for treating metal surfaces to inhibit corrosion until a protective coating such as paint can be applied. For example it is known to dip metal in a hot or cold solution of phosphoric acid in water and/or organic solvents. Iron or zinc phosphates and one or more surfactants may also be included in conventional phosphate solutions for treating metal surfaces. An inorganic phosphate layer is formed on the metal surface which inhibits corrosion. Treatment with a hot phosphate solution generally gives better corrosion protection than the use of a cold phosphate solution but requires a greater energy input.

The present invention relates to a method of treating the surface of metal to inhibit corrosion which method does not require elevated temperature. The method of treatment may also improve the adhesive strength of subsequently applied protective coatings e.g. paint.

According to the present invention a method of inhibiting corrosion of a metal surface comprises applying to the metal surface an organic solvent in which is dissolved a phosphate monoester of a hydroxyalkyl acrylate or alkylacrylate which phosphate monoester has the general formula;

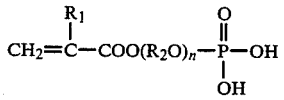

where $R_1$ is hydrogen, a methyl group or an ethyl group $R_2$ is an alkyl group having from 2 to 10 carbon atoms and n is a positive integer from 1 to 20.

Preferably, $R_1$ in the above general formula is hydrogen or a methyl group, $R_2$ is an alkyl group having from 2 to 5 carbon atoms and n is a positve integer from 1 to 3.

Phosphate monoesters of hydroxyalkyl acrylates and alkylacrylates are known and may be prepared by known methods. For example, U.S. Pat. No. 3,686,371 discloses a method for producing a copolymerisable monoester of phosphoric acid which comprises dropping phosphorous pentoxide into a hydroxyalkyl acrylate at a temperature of from 20° C. to 100° C. and then adding water. The phosphate esters may also be prepared by phosphating hydroxyalkyl acrylates or alkylacrylates with other phosphating agents e.g. phosphoric acid or phosphorous oxychloride.

The known methods for producing the phosphate monoesters of hydroxyalkyl acrylates or alkylacrylates may produce a mixture of phosphate monoesters and phosphate diesters of hydroxyalkyl acrylates or hydroxyalkyl alkylacrylates. For example, U.S. Pat. No. 3,855,364 discloses a method for preparing such a mixture which comprises reacting a hydroxyalkyl acrylate or methacrylate with polyphosphoric acid at a temperature of from 40° C. to 80° C., in the presence of a polymerisation inhibitor. Typically the mixture comprises from 55 to 75% of phosphate monoester, from 10 to 25% of phosphate diester and about 3 to 6% unreacted hydroxyalkyl acrylate or methacrylate and from 4 to 20% of free phosphoric acid.

It may not be necessary to isolate the phosphate monoester from such a mixture and the present invention includes a method in which an organic solvent containing a mixture comprising a phosphate monoester and a phosphate diester of hydroxyalkyl acrylate or hydroxyalkyl alkylacrylate is applied to the metal surface. The phosphate diester has the general formula;

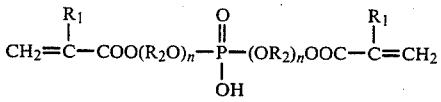

where $R_1$, $R_2$ and n are as defined above. Preferably such a mixture comprises at least 50% by weight of the phosphate monoester as hereinbefore defined and more preferably at least 70% by weight.

Hydroxyalkyl acrylates and hydroxyalkyl alkylacrylates having the general formula;

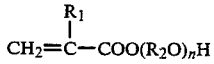

where $R_1$, $R_2$ and n are as defined above, are suitable organic solvents for the phosphate esters. If, therefore, the method of preparing the monoester for use in the method according to the present invention results in a mixture which includes a significant amount of unreacted hydroxyalkyl acrylate or alkylacrylate the mixture may be used in the method without the addition of further organic solvent. Generally, however, the amount of unreacted hydroxyalkyl acrylates or hydroxyalkyl alkylacrylates in the product mixture will be minimised for economic reasons and a relatively inexpensive organic solvent will be used such as, for example, toluene, xylene, acetone, trichloroethane, hexane or a $C_1$ to $C_{10}$ alcohol. Toluene is the preferred solvent.

The method of preparing the phosphate monoester of hydroxyalkyl acrylate or alkylacrylate may produce a mixture containing unreacted phosphating agent as hereinbefore indicated. Some phosphating agents e.g. phosphoric acid may have no adverse effect on the method according to the present invention. However, some phosphating agents may have an adverse effect, e.g. phosphorous oxychloride may promote corrosion, and should be removed before the mixture is applied to the metal surface.

Any concentration of the phosphate monoester in the organic solvent may be used. However, if the concentration is very low, repeated applications may be required in order to achieve good corrosion protection. The concentration may be as low as 0.01% by weight but is preferably at least 0.05% by weight. The upper limit of the concentration is determined by the solubility of the phosphate monoester in the organic solvent. Typically, the concentration is from 0.05% by weight to 10% by weight.

Any suitable method of applying the organic solution to the metal may be used such as, for example, brushing, spraying or immersion. The solution may be applied at ambient temperature i.e. about 20° C.

The method according to the present invention is particularly effective for inhibiting the corrosion of ferrous metals, but may also be useful for inhibiting the corrosion of non-ferrous metals such as, for example, aluminium or titanium.

The coating formed from a phosphate monoester of a hydroxyalkyl acrylate or alkylacrylate not only protects the metal surface from corrosion, it may also improve the adhesion of a subsequently applied organic coating to the metal surface. It is an important feature of this embodiment of the invention that the phosphate monoester of the hydroxyalkyl acrylate or alkylacrylate and the organic coating are applied sequentially since the improvement in adhesion may not be obtained if the phosphate monoester and the organic coating are mixed together and applied simultaneously.

The present invention includes a method of coating a metal surface which comprises applying to the metal surface a solution comprising an organic solvent in which is dissolved a phosphate monoester of a hydroxyalkyl acrylate or alkylacrylate as hereinbefore defined and thereafter applying to the surface an organic coating. The organic coating may be any of the known types of protective coatings based on film forming polymers or resins e.g. paints, varnishes and lacquers. It may in particular be a primer paint based on epoxy resin, vinyl resin, alkyd resin, polyester resin, chlorinated rubber, acrylated rubber or cyclised rubber.

The particularly suitable phosphate monoester of a hydroxyalkyl alkylacrylate for use in the present invention is mono(2-hydroxyethyl methacrylate) acid phosphate. A suitable mixture as herein before described comprises mono(2-hydroxyethyl methacrylate) acid phosphate, di(2-hydroxyethyl methacrylate) acid phosphate and 2-hydroxyethyl methacrylate.

The invention is illustrated with references to the following examples.

EXAMPLE 1

2-hydroxyethyl methacrylate was reacted with phosphorous oxychloride in the presence of pyridine. Unreacted phosphorous oxychloride was removed from the product to yield a mixture comprising approximately 80% by weight of mono(2-hydroxyethyl methacrylate) acid phosphate, 15% by weight 2-hydroxyethyl methacrylate and 5% di(2-hydroxyethyl methacrylate) acid phosphate. One part by weight of the mixture was added to 99 parts by weight of toluene to give a 0.8% by weight solution of the phosphate monoester.

A grit blasted mild steel panel was immersed in the solution for about one minute and then allowed to dry at ambient temperature (about 22° C.) for 24 hours. The panel was weighed and then placed in a 3.5% by weight solution of sodium chloride in distilled water for 7 days. The solution was continuously sparged with air to agitate and aerate the solution. At the end of the test period the panel was removed from the salt solution, de-rusted with ammoniacal acetylacetone solution, washed, dried and finally reweighed. The percentage weight loss (X) of the panel treated with the mono(2-hydroxyethyl methacrylate) acid phosphate solution was compared with the percentage weight loss (Y) of a similar mild steel panel which was also immersed in a 3.5% wt/wt salt solution for 7 days but which had not been treated according to the invention. The corrosion inhibition efficiency of the treatment according to the present invention was calculated from these weight losses as follows;

$$\text{Corrosion Inhibition Efficiency} = (Y - X)/Y \times 100\%$$

The corrosion inhibition efficiency was found to be 78%.

The example was repeated using 0.1 parts by weight of the mixture to 99.9 parts of toluene, i.e. a 0.08% by weight solution of the mono(2-hydroxyethyl methacrylate) acid phosphate, to treat the mild steel panel. Although the concentration of the solution was reduced by a factor of 10, the corrosion inhibition efficiency was found to be 34% i.e. a reduction by a factor of only 2.3.

For comparison the corrosion inhibition efficiently of a conventional cold phosphating treatment was measured. The mild steel panel was treated with a commercially available cold phosphating solution comprising zinc substituted phosphoric acid dissolved in chlorinated solvents and alcohols. The corrosion inhibition efficiency was found to be 27%.

EXAMPLES 2 AND 3

0.8% wt/wt and 0.08% wt/wt solutions of mono(2-hydroxyethyl methacrylate) acid phosphate were prepared by mixing 1 part by weight and 0.1 part by weight of the mixture prepared in Example 1 with 99 and 99.9 parts by weight of toluene respectively.

Ultrasonically cleaned 152×102 mm mild steel test panels were immersed in solutions of mono(2-hydroxyethyl methacrylate) acid phosphate for about one minute and then dried at ambient temperature for about 1 hour. The panels were then coated with an anti-corrosive primer paint based on alkyd resin and allowed to dry for 14 days at ambient temperature and in relative humidity of 50%. The paint was applied by spin coating and had an average film thickness of 70 microns.

The adhesive properties of the coating were assessed using a torque-shear adhesion tester. The test comprises fixing a 15 mm test piece to the surface of the coating with an epoxy adhesive. The epoxy adhesive has a greater adhesion to the test piece than the adhesion of the coating to the surface of the mild steel panel. A steadily increasing torque is applied to the test piece until the force is sufficient to shear the coating from the metal surface. The coating may fail either at the interface between the mild steel panel and the coating (adhesive failure) or in the bulk of the coating film (cohesive failure). Cohesive failure indicates that the adhesive strength of the coating is greater than its bulk strength and is therefore greater than the strength indicated by the torque-shear tester. Frequently a mixed adhesive—cohesive failure occurs and this is conventionally recorded as the percentage of the total area of the test piece which failed adhesively. The forces required to shear the primer coating from the surface of the mild steel test panels are given in Table 1 along with the percentage of adhesive failure.

For comparison, the same alkyd resin based primer was applied to a mild steel panel which had been treated with the commercially available cold phosphating solution used in Example 1 (Comparison A) and to a mild steel panel which had not been surface treated (Comparison B). The forces required to shear the coating from these panels and the percentage of adhesive failure are also given in Table 1.

Also for comparison, mild steel panels which had not been surface treated were coated with the alkyd resin based primer which had been modified by the addition of 1% (Comparison C) or 0.1% (Comparison D) by weight of the mixture containing mono(2-hydroxyethyl methacrylate) acid phosphate as prepared in Example 1. The forces required to shear the modified coating from these panels and the percentage adhesive failure are also given in Table 1.

The results in Table 1 show that the treatment according to the present invention Examples 2 and 3, increased the adhesion of the coating to the surface of the mild steel panel as compared to the panels which had received no pretreatment whereas the treatment with the commercially available product, Comparison A, substantially decreased the force required to shear the coating. The coatings applied to the panels treated according to the present invention, Examples 2 and 3, failed cohesively and so the adhesive strength of the coatings is actually greater than that indicated by the test results.

Comparison of the results for Examples 2 and 3 with the results for Comparisons B, C and D show that pretreating the metal panels according to the present invention increased the adhesion of the subsequently applied primer coating whereas coating untreated panels with a primer containing the mono(2-hydroxy ethyl methacrylate) acid phosphate did not substantially affect the force required to shear the coating and only slightly improved the percentage adhesive failure.

TABLE 1

| | | Force required to shear the coating ($N/mm^2$) | % Adhesive Failure |
|---|---|---|---|
| Example 2 | panels pre-treated with a solution containing 0.8% by weight mono (2-hydroxy ethyl methacrylate) acid phosphate | 25.3 ± 1.2 | 0 |
| Example 3 | panels pre-treated with a solution containing 0.08% by weight mono (2-hydroxy ethyl methacrylate) acid phosphate | 26.8 ± 1.8 | 0 |
| Comparison A | panels pre-treated with a commercial cold phosphating solution | 4.7 ± 3 | 100 |
| Comparison B | no pre-treatment | 22.1 ± 1.4 | 90 |
| Comparison C | no pre-treatment but 0.8% wt mono (2-hydroxy ethyl methacrylate) acid phosphate added to primer coating | 19.9 ± 3.7 | 73 |
| Comparison D | no pre-treatment but 0.08% wt mono (2-hydroxy ethyl meth-acrylate) acid phosphate added to primer coating | 21.5 ± 2.5 | 70 |

EXAMPLE 4

1 part by weight of the mixture containing mono(2-hydroxyethyl)methacrylate as prepared in Example 1 was added to 99 parts by weight of toluene to give 0.8% by weight solution of the phosphate monoester. The solution was applied using a paint brush to one third of the surface area of a grit blasted mild steel panel measuring approximately 305 mm×102 mm×6 mm. Another third of the panel was brush coated with the same commercially available cold phosphating solution as used in Example 1. The final third of the panel remained untreated. The treated panel was allowed to dry and then the thickness of each pretreatment layer was measured. The average layer thickness over the area treated according to the present invention was less than 0.5 μm whereas the average layer thickness over the area treated with the commerical cold phosphating solution was 1.5 μm.

The panel was subjected to natural weathering in an industrial environment for 28 days. The three areas of the panel were then assessed for rusting according to ASTM 610-68. The rusting evaluation test ASTM 610-68 is a visual test of the specimens in which values are assigned on a scale of 0 to 10 where 10 is a good result (no rusting) and 0 is a bad result (100% of the surface rusted). The area of the panel which had not been treated was severly rusted and was assigned the rating 1. Both of the areas which received pretreatment were rusted over a relatively small area and were both assigned the ratings 8. Thus, the treatment according to the present invention performed as well as the treatment with the commercially available cold phosphating solution even though the treatment resulted in a layer which was less than one third of the thickness of the layer obtained using the commerical material.

EXAMPLE 5

Two mild steel panels were cleaned by abrading with a file while immersed in toluene. The panels were allowed to dry for 10 minutes at room temperature (approximately 23° C.) and a relative humidity of 45%. One of the panels was then washed with 10 $cm^3$ of a solution comprising 99 parts by weight of toluene and 1.0 parts by by weight of the mixture containing mono(2-hydroxyethyl methacrylate) acid phosphate as prepared in Example 1. This was followed by three further washes with 10 $cm^3$ of toluene. The other panel was also washed four times but all four washes were with 10 $cm^3$ of toluene. The two panels were then placed in boiling water for 10 minutes. After drying, the panels were visually inspected for rusting. The panel treated only with toluene was severely rusted whereas there were no signs of corrosion on the panel treated according to the present invention.

We claim:

1. A method of inhibiting corrosion of a metal surface comprising applying to the metal surface an organic solvent in which is dissolved a phosphate monoester of a hydroxyalkyl acrylate or alkylacrylate which phosphate monoester has the general formula;

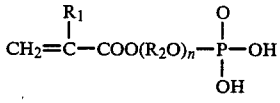

where $R_1$ is hydrogen, a methyl group or an ethyl group $R_2$ is an alkyl group having from 2 to 10 carbon atoms and n is a positive integer from 1 to 20.

2. A method as claimed in claim 1 in which the phosphate monoester of the hydroxyalkyl acrylate or hydroxyalkyl alkylacrylate has the general formula;

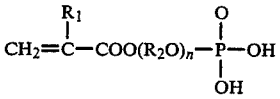

where $R_1$ is hydrogen or a methyl group $R_2$ is an alkyl group having from 2 to 5 carbon atoms and n is a positive integer of from 1 to 3.

3. A method as claimed in claim 1 or claim 2 in which the organic solvent contains a phosphate diester in addition to the phosphate monoester, which phosphate diester has the general formula;

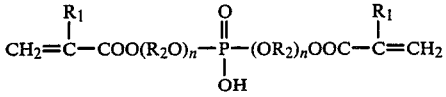

where $R_1$ is hydrogen, a methyl group or an ethyl group $R_2$ is an alkyl group having from 2 to 10 carbon atoms and n is a positive integer from 1 to 20.

4. A method as claimed in claim 3 in which the mixture comprises at least 50% by weight of the phosphate monoester.

5. A method as claimed in claim 3 in which the mixture comprises at least 70% by weight of the phosphate monoester.

6. A method as claimed in claim 3 in which the organic solvent also contains a hydroxyalkyl acrylate or a hydroxyalkyl alkylacrylate having the general formula;

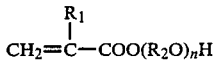

where $R_1$ is hydrogen, a methyl group or an ethyl group $R_2$ is an alkyl group having from 2 to 10 carbon atoms and n is a positive integer from 1 to 20.

7. A method as claimed in claim 1 in which the organic solvent is selected from the group comprising toluene, xylene, acetone, trichloroethane hexane and $C_1$ to $C_{10}$ alcohols.

8. A method as claimed in claim 1 in which the organic solvent is a hydroxyalkyl acrylate or a hydroxyalkyl alkylacrylate having the general formula;

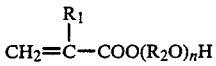

where $R_1$ is hydrogen, a methyl group or an ethyl group, $R_2$ is an alkyl group having from 2 to 10 carbon atoms and, n is a positive integer from 1 to 20.

9. A method as claimed in claim 1 in which the organic solution contains at least 0.01 by weight of the phosphate monoester.

10. A method as claimed in claim 1 in which the organic solution contains from 0.05 to 10% by weight of the phosphate monoester.

11. A method as claimed in claim 1 in which the phosphate monoester is mono(2-hydroxyethyl methacrylate) acid phosphate.

12. A method as claimed in claim 3 in which the phosphate diester is di(2-hydroxyethyl methacrylate) acid phosphate.

13. A method of inhibiting corrosion of a metal surface comprising applying to the metal surface a mixture comprising mono(2-hydroxyethyl methacrylate) acid phosphate, di(2-hydroxyethyl methacrylate) acid phosphate and 2-hydroxyethyl methacrylate which mixture is dissolved in an organic solvent selected from the group comprising toluene, xylene, acetone, trichloroethane, hexane and $C_1$ to $C_{10}$ alcohols.

14. A method of treating a metal surface to improve corrosion inhibition and to increase the adhesion to the metal surface of a subsequently applied organic coating comprises applying to the surface an organic solvent in which is dissolved a phosphate monoester of a hydroxyalkyl acrylate or alkylacrylate according to the method of claim 1 and thereafter applying an organic coating.

15. A method as claimed in claim 14 in which the organic coating is a primer paint based on epoxy resin vinyl resin, alkyd resin, polyester resin, acrylated rubber, chlorinated rubber or cyclised rubber.

16. A method as claimed in claim 1 in which the metal surface is the surface of a ferrous metal.

* * * * *